US010116103B1

(12) United States Patent
Patwardhan

(10) Patent No.: US 10,116,103 B1
(45) Date of Patent: Oct. 30, 2018

(54) POWER CONNECTOR WITH INTEGRATED DISCONNECT

(71) Applicant: Satyajit Patwardhan, Fremont, CA (US)

(72) Inventor: Satyajit Patwardhan, Fremont, CA (US)

( * ) Notice: Subject to any disclaimer, the term of this patent is extended or adjusted under 35 U.S.C. 154(b) by 0 days.

(21) Appl. No.: 15/844,550

(22) Filed: Dec. 17, 2017

(51) Int. Cl.
*H01R 13/66* (2006.01)
*H01R 13/688* (2011.01)

(52) U.S. Cl.
CPC ..... *H01R 13/688* (2013.01)

(58) Field of Classification Search
CPC ..... H01R 13/713
USPC ..... 439/2
See application file for complete search history.

(56) References Cited

U.S. PATENT DOCUMENTS 4,932,882 A * 6/1990 Kang ..... H01R 39/64 439/21
5,409,403 A * 4/1995 Falossi ..... H01R 24/38 439/21
5,484,294 A * 1/1996 Sobhani ..... H01R 35/04 439/21
5,690,498 A * 11/1997 Sobhani ..... H01R 35/04 439/22
5,704,792 A * 1/1998 Sobhani ..... H01R 39/64 439/21
6,000,948 A * 12/1999 Peterson ..... H04R 1/08 439/22
6,048,211 A * 4/2000 Liaom ..... B65H 75/48 439/22
6,299,454 B1 * 10/2001 Henderson ..... H01R 39/64 439/15
6,302,743 B1 * 10/2001 Chiu ..... H01R 25/003 439/22
6,331,117 B1 * 12/2001 Brundage ..... H01R 39/64 361/728
6,981,895 B2 * 1/2006 Potega ..... H01R 24/58 439/218
7,101,187 B1 * 9/2006 Deconinck ..... H01R 39/64 439/22
7,749,008 B2 * 7/2010 Klassen ..... H01R 13/2471 439/201
7,802,995 B2 * 9/2010 Lai ..... H01R 35/02 439/21
7,841,865 B2 * 11/2010 Maughan ..... H01R 13/629 439/66
8,079,846 B1 * 12/2011 Cookson ..... A61B 5/00 439/13

(Continued)

*Primary Examiner* — Ross Gushi

(57) ABSTRACT

This invention teaches a connector design that has the capability to safely disconnect the power flowing through the connector when misalignment of the two connector halves is detected. Monitoring contactors disposed on different locations on the connector and are made to carry or not-carry (depending the contact position in the connector), a pilot signal generated by one of the connector halves. The presence or absence of the pilot signal on the individual contacts is monitored by the other connector half. A safe and automatic power disconnects ensues when the two connector halves misalign. This happens well before the primary power contact disengage. The clever design detects not only in-plane misalignments, but also out of plane misalignments.

1 Claim, 5 Drawing Sheets

(56) References Cited

U.S. PATENT DOCUMENTS

| | | | | |
|---|---|---|---|---|
| 8,142,200 | B2 * | 3/2012 | Crunkilton | A61N 7/02 439/21 |
| 8,724,825 | B2 * | 5/2014 | Birch | H04R 1/083 381/370 |
| 9,203,184 | B1 * | 12/2015 | Hui | H01R 13/629 |
| 9,413,128 | B2 * | 8/2016 | Tien | H01R 13/52 |
| 9,531,118 | B2 * | 12/2016 | Byrne | H01R 13/2421 |
| 9,685,742 | B2 * | 6/2017 | Liu | H01R 13/713 |
| 2010/0075512 | A1 * | 3/2010 | Lai | H01R 35/02 439/66 |
| 2014/0099801 | A1 * | 4/2014 | Liao | H01R 13/6205 439/39 |

* cited by examiner

POWER CONNECTOR WITH INTEGRATED DISCONNECT

FIELD OF THE INVENTION AND PRIOR ART RELATED TO THE INVENTION

The field of invention is electrical connectors. Specifically, power connectors that are able to detect misalignment between the two halves of the connector and automatically disable the power before mechanical contact disengagement happens.

In the prior art, there are several connectors described, that allow rotational misalignment of the two connector halves. One such example is described in FIG. 1, which is essentially a version of flat slip ring. As shown in FIG. 2, such connector allows power transmission independent of relative orientation. However, if the two connector halves have an in-plane misalignment as shown in FIG. 3, the power connection across the connector can get uncontrollably interrupted, which can lead to hazards such as sparking.

This invention teaches a series of features and additional contacts that can be added to this basic connector such that the power transfer across the connector can be safely terminated before any hazardous or uncontrolled disconnection happens.

With the re-birth of electric vehicles (EVs), their charging system and in particular automatic or robotic charging system is fast becoming key enabling technology. At the core of such charging system is a high current capacity connector, that is compact and can tolerate several degrees of misalignment. The connector's tolerance to rotational misalignment allows for robot to have one less degree of freedom, thus reducing its complexity and that of the end effector. However, the chassis of an EV or for that matter any vehicle is floating on its suspension springs and consequently the charge port attached to the chassis of a parked EV can still move several inches when the drive closes the door, or puts groceries in the car. Connector disclosed in this invention allows for the necessary degrees of freedom, while safely disengaging the charging power when any hazard is detected.

DETAILED DESCRIPTION OF THE INVENTION

Electrical power connectors have two halves, each carrying a group of connectors. These connector halves are brought together to mate with each other in a particular relative orientation. Frequently, the connectors have mechanical guides on one or both halves to guide the mating process into correct orientation such that each of the contacts from the first half mates with its matching counterpart from the second half. However, if such a connector is manipulated by an automatically charging robot, the built in mechanical guides of a connector can create an over constrained system and any motion of the vehicle can impose significant stresses on the robot arm holding the connector. One option is to eliminate the mechanical registering of the contactor halves and allow them to move with respect to each other. This invention teaches a critical component of such register-free connector design. In particular it teaches a connector design that has built in checks for misalignment. With the elimination of mechanical registering, these safety checks play a critical role.

Figure 1:
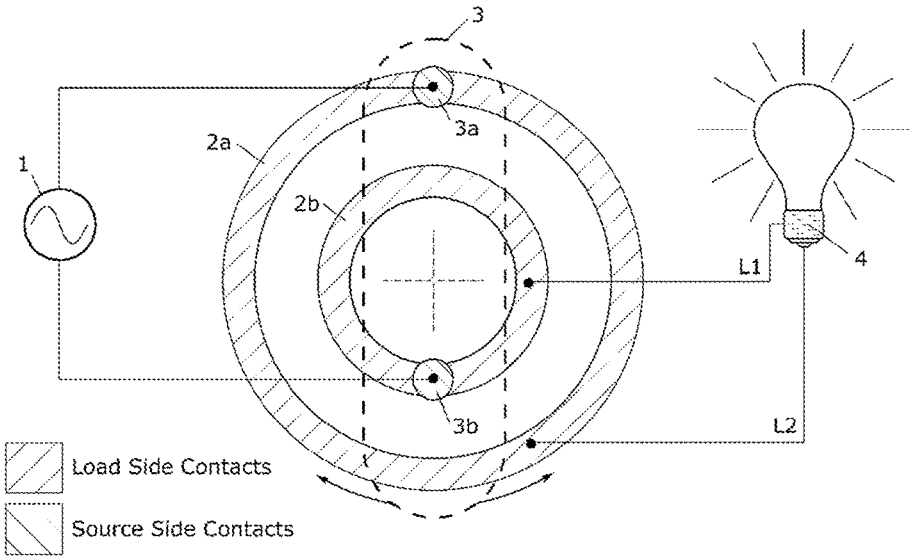
FIG. 1: Connector agnostic to angular orientation, shown in basic orientation (prior art).
Figure 2:
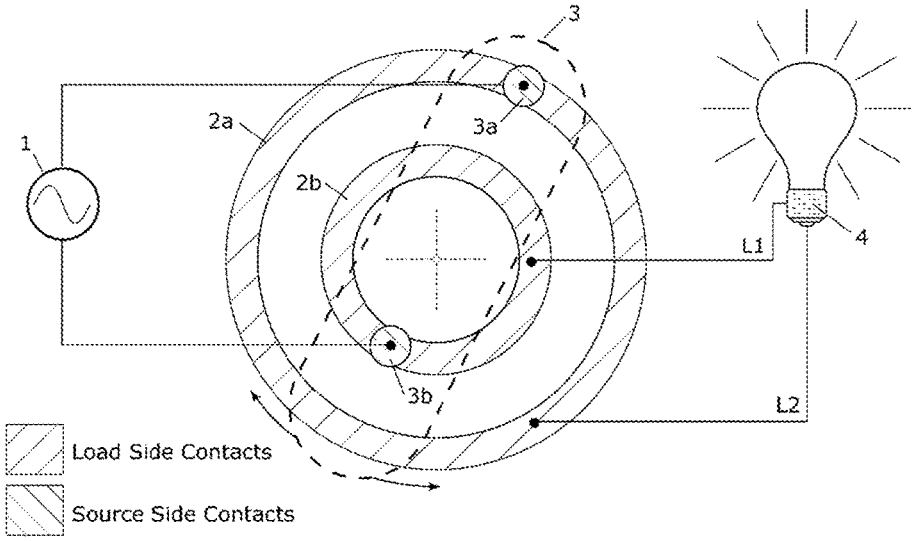
FIG. 2: Connector agnostic to angular orientation, shown with rotational misalignment (prior art).
Figure 3:
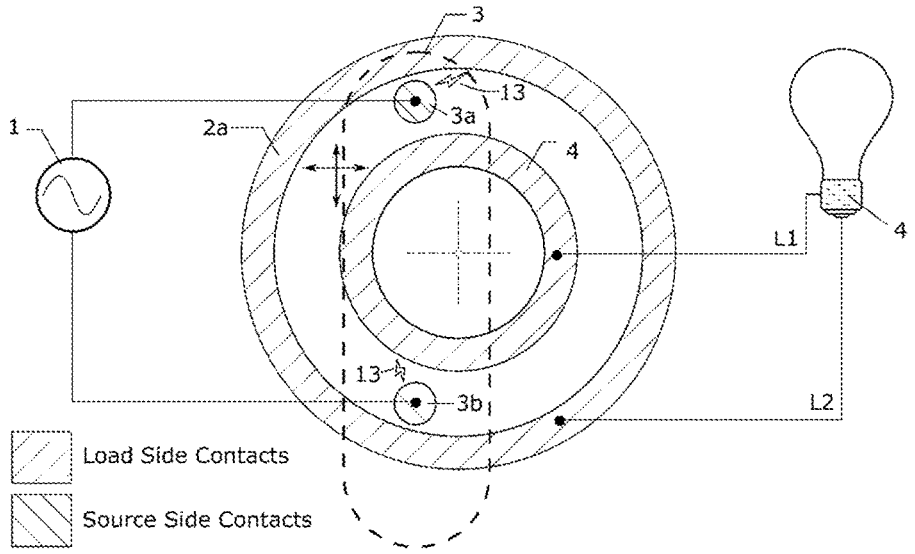
FIG. 3: Connector agnostic to angular orientation, shown in-plane translational misalignment (prior art).

A basic register free connector described in prior art is shown in figures FIG. 1, FIG. 2 and FIG. 3. The primary function this connector serves is to connect an electricity source 1 to an electricity load 4. The source side of the connector comprises of ring contacts 2*a* and 2*b*. The load side of the connector comprises of a body 3 and connectors 3*a* and 3*b*. When correctly aligned, the electrical energy transfer is enabled by the two contact pairs 2*a*-3*a* and 2*b*-3*b*. As shown in FIG. 2, the connector continues work properly even when the two halves of the connector are rotationally misaligned. However, when the two connector halves are misaligned along in-plane translation (see FIG. 3); one or both of the contact pairs 2*a*-3*a* and 2*b*-3*b* may disengage from each other. Since the source 1 and load 4 are high voltage and high current electrical devices, this uncontrolled interruption in the circuit may cause hazards such as sparks 13 across the disconnection.

The Arrangement:

Following describes one of the embodiments of the disclosed invention, and it does so by modifying the basic connector shown in FIG. 1. However, it should be noted that the incremental features added to the basic connector of FIG. 1 can be added to any other equivalent connector. The core teaching of this invention is these incremental features that add the misalignment protection to any basic register-free connector. For the purposes of clarify, following description will add these features to the connector picturized in FIG. 1.

Figure 4:
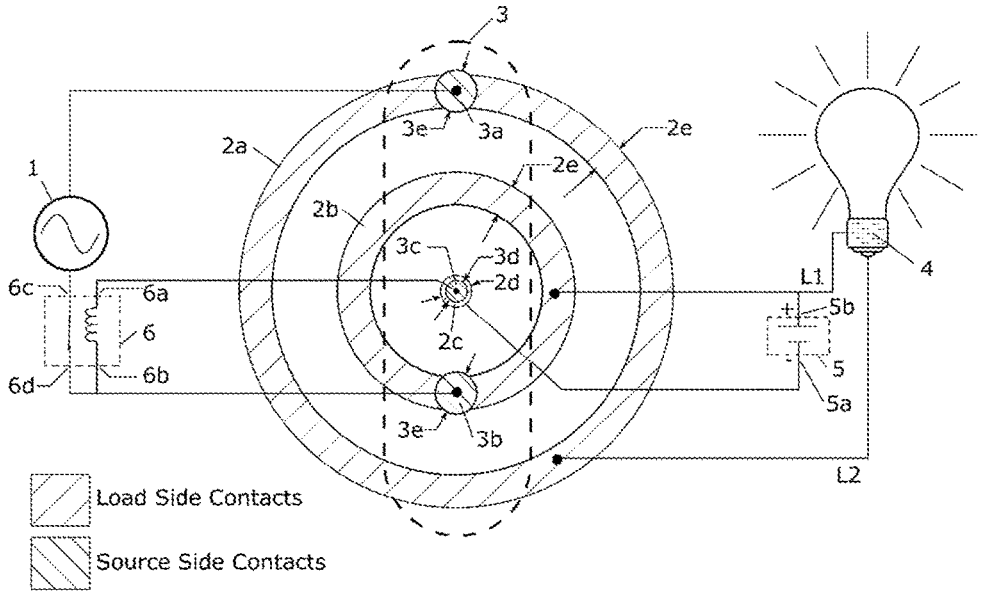
FIG. 4: Basic embodiment of the invention, shown in correctly aligned position.

One of the embodiments of this invention is shown in FIG. 4. In this embodiment, a center contact pair 2*c* and 3*c* is added to connector. The contacts 2*c* and 3*c* have diameters 2*d* and 3*d* respectively. A small electricity source 5 is added to the load side of the circuit. One of the terminals (5*a*) of the power source 5 is connected to the center contact 2*c*, which further connects to the contact 3*c*. The contact 3*c* is further connected to one of the terminals (6*a*) of energizing coil of a normally-open relay 6. The other terminal 6*b* of the relay's energizing coil is connected through a convenient arrangement to second terminal (5*b*) of the power source 5. In the rendition shown in FIG. 4, contact pair 2*b*-3*b* is used to route the connection from 6*b* to 5*b*. However, any other equivalent arrangement could equally work. The relay 6 Is placed in series with the electricity source. As shown in FIG.

4, when the two halves of the connector are correctly aligned, relay 6 is turned on and electrical energy flows from source 1 to load 4.

Figure 5:
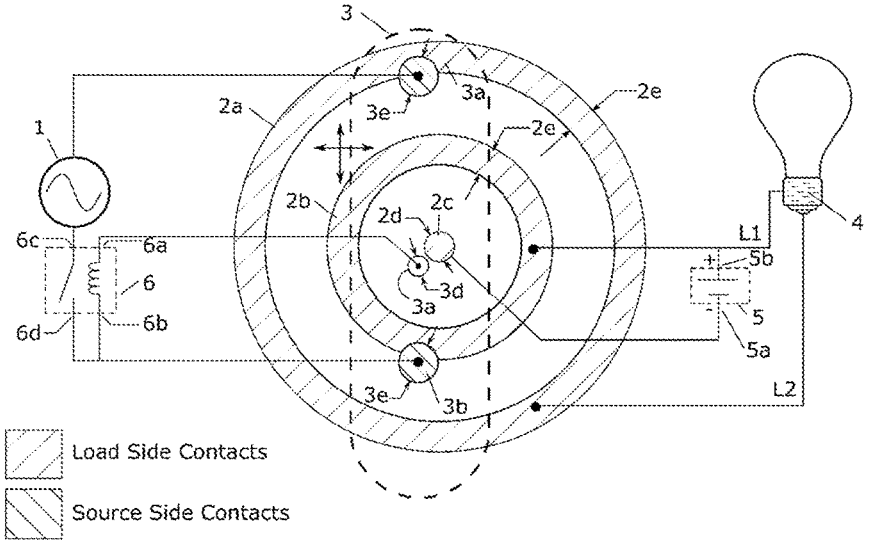
FIG. 5: Basic embodiment of the invention, shown with in-plane translational misalignment.

Operation:

As shown in FIG. 5, when the two halves of the connector 2 and 3 are misaligned more than $(2d+3d)/2$, the connection between contacts 2*s* and 3*c* breaks. The dimensions 2*d* and 3*d* should be suitably chosen such that 2*c*-3*c* disconnection happens before any of the other contact pairs (such as 2*a*-3*a* pair or 2*b*-3*b* pair in this example) disconnect. In general, this is a case specific problem and depends on the specific geometry of the register-free connector to which this invention is applied to. In the specific case described here, let's assume that the dimensions of conductors 2*a*, 2*b*, 3*a* and 3*b* are as shown in FIG. 4, and are respectively 2*e*, 2*e*, 3*e* and 3*e*. Then, in order to guarantee that the pair 2*c*-3*c* is the first one to disengage, one needs to ensure $(2d+3d)/2<(2e+3e)/2$. Note that the source 5 is a low voltage source and energizing coil of relay 6 also needs minuscule current. As a result, interrupting contact pair 2*c*-3*c* dies not pose any hazards. However, this disconnection happening earlier than that of power contacts 2*a*-3*a* or 2*b*-3*b* averts the primary risk of sparking at power contacts.

Refinement 1:

The embodiment in FIG. 4 has one shortcoming and that is it is incapable of reporting the direction of the misalignment. In the embodiment shown in FIG. 6, the connector is capable of generating the misalignment information. In the FIG. 6, a conductive boundary surface 7 is added to the load-side connector half. On the source-side connector half at least three contacts—labeled as 8*a*, 8*b* and 8*c* are added. The terminal 5*b* of the small electricity source 5 is connected the new conductive boundary surface 7 and the terminal 5*a* is connected to contact 2*c*—same as the embodiment of FIG. 4. The contacts 8*a*, 8*b* and 8*c* are connected to the input of a logical AND gate 9. The output of the AND gate 9 is connected to the first terminal 6*a* of the energizing coil of relay 6. The second terminal 6*b* of the energizing coil of the relay 6 is connected to contact 3*c*. When the two connector halves are correctly aligned, all three contacts 8*a*, 8*b* and 8*c* make contact with the conductive boundary surface 7, which in turn is connected to the positive terminal 5*b* of the energy source 5. As a result, the logic pattern 10—which is same as the input to the AND gate 9 is set to all 1's where 1 represents the presence of a voltage and 0 represents an absence of voltage. The AND gate 9 produces a logical high output and energizes the relay 6. Consequently, the connector connects the source 1 to the load 4.

Figure 7:
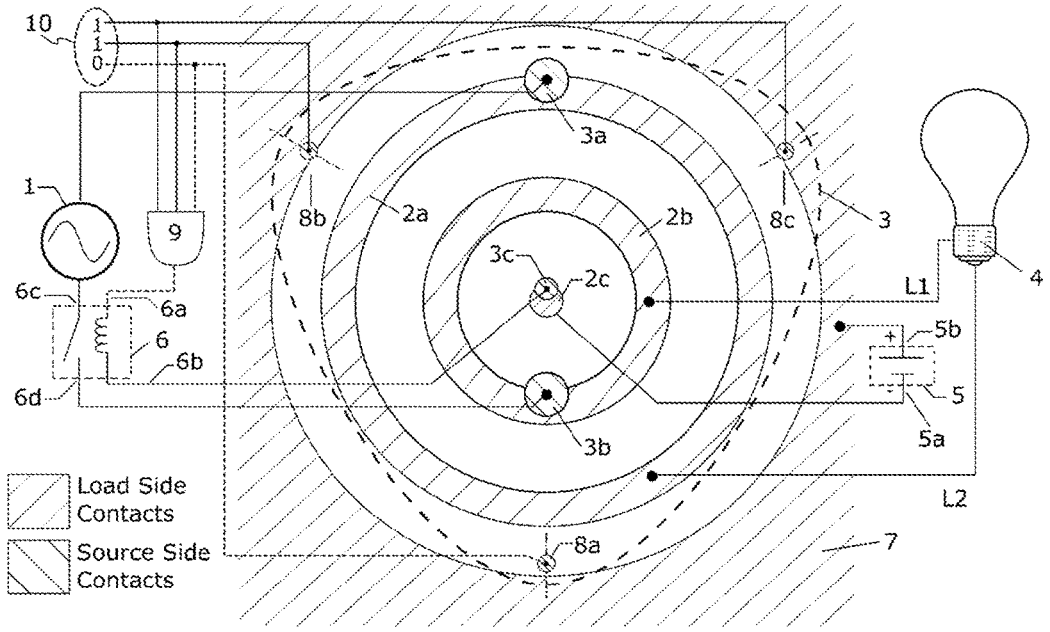
FIG. 7: First refined embodiment of the invention, shown with in-plane translational misalignment.
Figure 8:
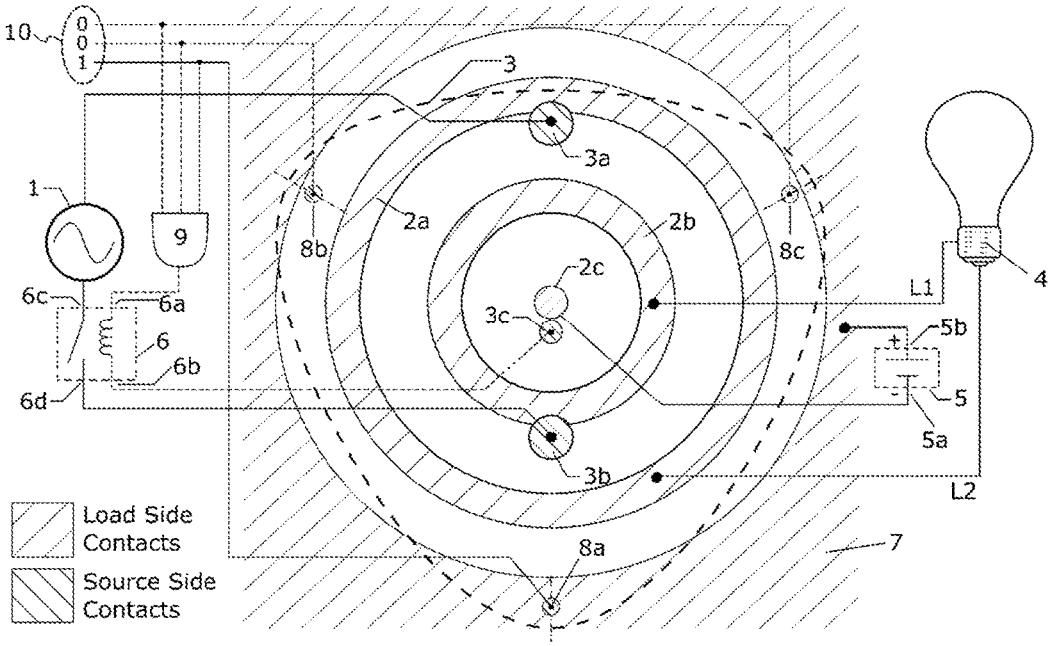
FIG. 8: First refined embodiment of the invention, shown with in-plane translational misalignment.

FIG. 7 and FIG. 8 show the same embodiment, but with the two connector halves misaligned in two opposite directions respectively. When misaligned, one or more the contacts 8*a* or 8*b* or 8*c* disconnects from conductive boundary surface and consequently one or more entries of the logic pattern 10 and consequently the input of the AND gate 9 become 0, where 0 means absence of voltage and 1 means presence of voltage. The AND gate does not produce a logical high output and does not energize the relay 6 and consequently the connector does not connect the source 1 to load 4. Note that the misalignment of the two connector halves is in the direction of the contacts producing the 0 entry in the logic pattern 10. As a result, pattern 10 contains necessary information regarding misalignment direction.

Figure 6:
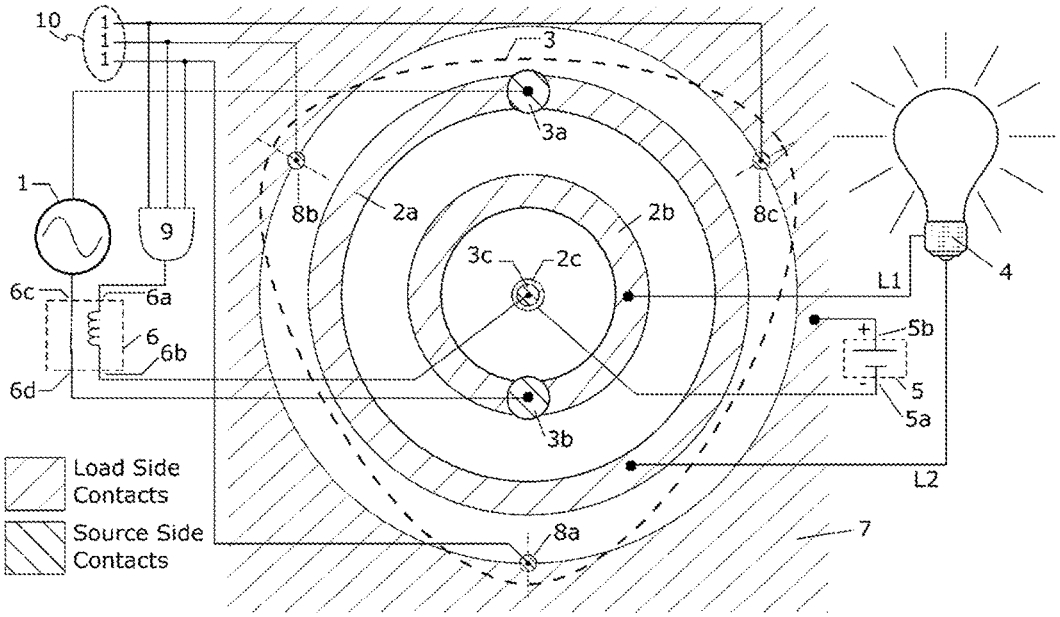
FIG. 6: First refined embodiment of the invention, shown in correctly aligned position.
Figure 10:
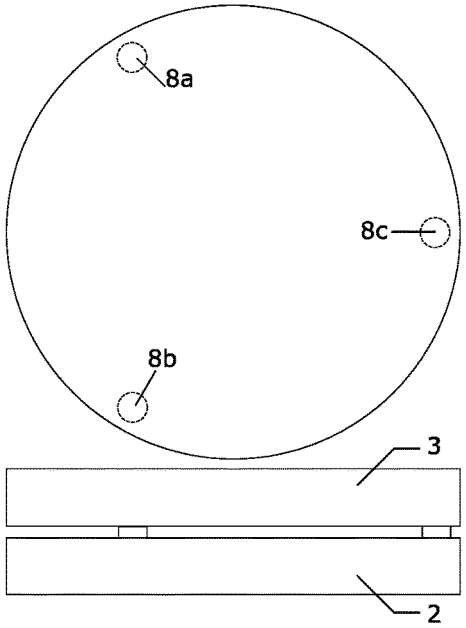
FIG. 10: Side view of an embodiment of the invention without any out-of-plane misalignment.
Figure 11:
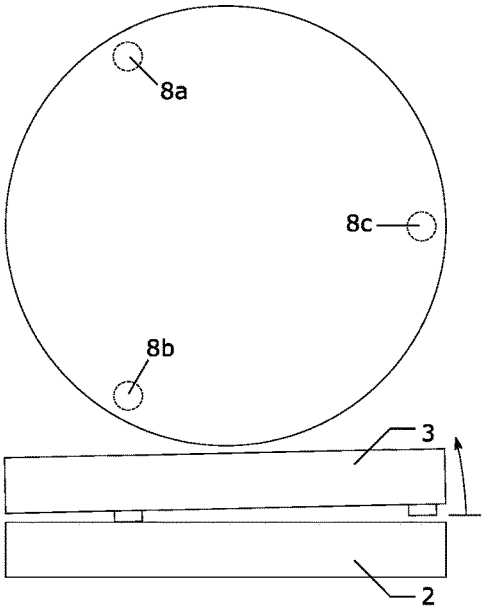
FIG. 11: Side view of an embodiment of the invention with out-of-plane misalignment.

In the embodiment presented in FIG. 6, only three contacts 8*a*, 8*b* and 8*c* are used. It is easy understand this count of conductors can be increased to uniformize the sensitivity of misalignment detection along all directions. However, the count of 3 is particularly important because geometrically three non-colinear contacts are necessary and sufficient to define the relative position of two halves of the connector (see FIG. 10). The converse of this property is beneficially used in this invention. As shown in FIG. 11, any misalignment pulling the two halves of the connector away from each other will by—definition; disconnect at least one of the three contacts 8*a*, 8*b* or 8*c*. As a result, the relay 6 will be immediately de-energized and the source 1 and load 4 will be safely disconnected from each other.

Figure 9:
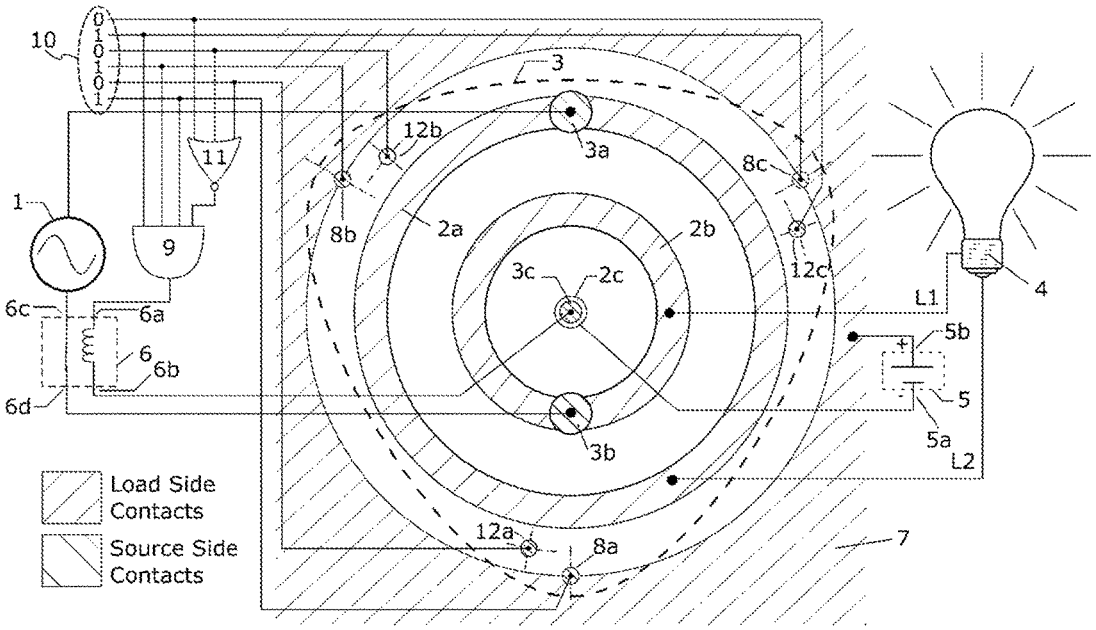
FIG. 9: Second refined embodiment of the invention, shown in correctly aligned position.

Refinement 2:

The embodiment of FIG. 6 produces the misalignment information, but it does not do so in a uniform manner. For example, a shorter misalignment in the direction shown in FIG. 7 produces a change in pattern 10. However relatively larger misalignment in opposite direction (shown in FIG. 8) is required to change the pattern 10. In general, if more contacts 8 (of the type 8*a*, 8*b* and 8*c*) are added to the source-side connector half, the overall non-uniformity can be significantly reduced. However, more than three such contacts will need spring loaded contacts since first three contacts already define the relative position of the two connector halves. Any additional contacts will need to mounted compliantly. The embodiment shown in FIG. 9 provides an alternative way to uniformize the misalignment detection. Here, three additional contacts 12*a*, 12*b*, 12*c* are added to source-side connector half. The location of 12*a*, 12*b* and 12*c* is such that when the connector halves are properly aligned, the contact 12*a*, 12*b* and 12*c* do not connect with the conductive boundary surface and contribute 0 to the pattern 10, where 0 means absence of voltage. In order to properly use this, the contacts 12*a*, 12*b* and 12*c* are connected to the input of a NOR gate 11. The NOR gate 11 produces a logical 1 output when all of the 12*a*, 12*b* and 12*c* are disconnected from conductive boundary plane. This logical 1, together with logical 1's from 8*a*, 8*b* and 8*c* feed into AND gate 9. The AND gate 9 then produces logical 1 and turns on the relay 6. Thus, in turn the power connector connects source 1 to load 4. When properly aligned the pattern 10 reads alternate 0 and 1s. Any departure from this pattern indicates specific direction of misalignment and turns off the relay 6.

Application:

One of the important application of this technology is in the field of robotic hands-free charging of electric vehicles (EVs). In this application, a robot end effector would be installed with one half of an EV charging connector, and the other half would be installed on the electric vehicle. When the EV is to be charged, the robot would move its end effector and the attached connector half to bring it next to the connector half mounted on the EV. If this connector is to be designed as described in this invention, any motion of the car that would cause large misalignment of the two contactor halves will be addresses safely by immediately disconnecting the charging power. Also, the contactor arrangement will offer a reliable way for the robot to understand the direction of misalignment. This will also help robot to compensate for the misalignment. This ability to be able to detect the direction of misalignment is also helpful in guiding the robot during initial engagement of the connector.

What is claimed is:

1. A connector comprising:

a. a first half and a second half, b. a first axis for the first half, c. a second axis defined for the second half, d. the first half being able to mate with the second half, and transmit a first group of n electrical signals across from the first half to the second half, and then to a second group of n electrical signals, when the first and the second axis are parallel, but separated by no more than a distance M, where $n \geq 1$, e. a first contact, attached to the first half and with its largest dimension perpendicular to the first axis as D, and mounted along the first axis, f. a second contact, attached to the second half and with its largest dimension perpendicular to the second axis as d, and mounted along the second axis, g. with $(D+d)/2<M$, h. a first electrical energy source having a first and a second terminal, with its first terminal connected to the first contact, i. a first form-A relay with a first and second switching terminal, and with an energizing coil having a third and fourth terminal, j. the third terminal of the first relay, connected to the second contact, k. the second terminal of the first relay, connected to one of the electrical signals from the first group of n signals.

* * * * *